US006538240B1

(12) United States Patent
Shon et al.

(10) Patent No.: US 6,538,240 B1
(45) Date of Patent: Mar. 25, 2003

(54) METHOD AND APPARATUS FOR CONTROLLING A MICROWAVE OVEN

(75) Inventors: Jong-Chull Shon, Suwon (KR); Keun-Seuk Oh, Suwon (KR); So-Hyun Lee, Suwon (KR); Won-Woo Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/005,366

(22) Filed: Dec. 7, 2001

(51) Int. Cl.[7] ..... H05B 6/68

(52) U.S. Cl. ..... 219/707; 219/719; 219/704; 99/325

(58) Field of Search ..... 219/707, 719, 219/704, 705, 492, 702; 99/325, DIG. 14

(56) References Cited

U.S. PATENT DOCUMENTS

RE31,094 E 11/1982 Kobayashi et al. ..... 219/707
4,864,088 A * 9/1989 Hiejima et al. ..... 219/492
5,349,163 A * 9/1994 An ..... 219/707
5,545,881 A * 8/1996 Chai et al. ..... 219/719
5,681,496 A * 10/1997 Brownlow et al. ..... 219/707

FOREIGN PATENT DOCUMENTS

JP 60-196521 * 10/1985 ..... 219/707

* cited by examiner

*Primary Examiner*—Philip H. Leung
(74) *Attorney, Agent, or Firm*—Staas & Halsey LLP

(57) ABSTRACT

A microwave oven, and method of controlling the same, including a magnetron generating high-frequency waves and a sensor detecting the environmental state of air in a cooking cavity. During a first cooking time, outputs of the sensor are sampled at predetermined periods, with the duration of first cooking period being calculated, by a controller, based on the result of the sampling. Thereafter, a second cooking time is calculated, by the controller, based on the first cooking time and the kind of food. A cooking operation is then completed for the second cooking time.

22 Claims, 5 Drawing Sheets

METHOD AND APPARATUS FOR CONTROLLING A MICROWAVE OVEN

BACKGROUND OF THE INVENTION

1. Field of the Invention

The present invention relates generally to microwave ovens, and more particularly to a microwave oven control method and apparatus in which the humidity of air in a cooking cavity can be accurately detected without cooling the cooking cavity.

2. Description of the Related Art

In general, a microwave oven performs a cooking operation with the aid of a variety of sensors including environmental sensors, such as a humidity sensor, a temperature sensor and a gas sensor, and a weight sensor for detecting the weight of food.

The cooking operation is performed in such a way that a user selects a desired cooking item from an automatic cooking menu while food is laid on a turntable-type cooking tray in the cooking cavity of a microwave oven. In this case, the microprocessor of the microwave oven may receive the outputs of a humidity sensor, calculate a cooking time based on preset data and conditions, and control the operation of the magnetron of the microwave oven according to the result of the calculation.

In a conventional microwave oven control method, the lapse of a first cooking time is determined by calculating the slope of the output value curve of a sensor and determining whether the slope of the output value curve of the sensor is equal to a preset reference slope, a second cooking time is determined based on the first cooking time and a factor preset according to the kind of food, and a cooking operation is completed for the second cooking time.

However, in the conventional microwave oven method, while cooking operations are sequentially performed, current environmental conditions for temperature, humidity and gas sensors differ from those of a preceding cooking operation, so the slope of the output value curve of a sensor is changed, thereby making it difficult to determine the first cooking time. Accordingly, an initial waiting time of about twenty seconds should be set prior to starting a new cooking operation. That is, the magnetron is again operated after the magnetron has been stopped and the fan has been operated to cool the cooking cavity for the initial waiting time of about twenty seconds.

FIG. 1 is a graph explaining a conventional microwave oven control method.

Referring to FIG. 1, the cooling of a cooking cavity is performed for an initial waiting time TC of about twenty seconds at the first stage of a cooking operation. A first cooking time T1 is set as a period of time ranging from the end of the initial waiting time TC till the coincidence of the slope of the output value curve of the sensor with a preset reference slope A. Thereafter, a second cooking time T2 is set based on the first cooking time and a factor preset according to the kind of food. A cooking operation is completed for the second cooking time.

In one conventional system, the transition between the first cooking time T1 and the second cooking time T2 is based on an output of a humidity sensor, specifically a curve representative of the percentage of humidity detected over time. The conventional system determines when slope A has been met based on a detection of when a sampled humidity exceeds a predetermined amount. This predetermined amount had been determined, through experimentation, to typically be the point along the curve where an abrupt change occurs, ideally at the slope A position, for a particular food. However, such systems are very inaccurate as most real world foods do not match their ideal counterparts. Thus, a factory predetermined humidity level representative of an ideal point of abrupt change along such a curve will not typically match a real world point of abrupt change along a similar curve. In the conventional system, the actual slope of the curve is not detected, rather it is predicted that the abrupt change will occur at a certain sensor output, regardless of the actual slope of the curve. Therefore, an improved method and apparatus for actually detecting the approximate position of real world abrupt curve changes along an output sensor curve is necessary, rather than merely predicting where such abrupt curve change may occur.

In addition, as described above, in the conventional microwave oven, the cooling of the cooking cavity is performed by operating only a fan for the initial waiting time at the first stage of a cooking operation. Thus, because of the initial waiting time, the entire cooking time is lengthened and the power consumption of the microwave oven is increased. Even though the cooling of the cooking cavity is performed, an accurate control of the cooking operation becomes difficult because the control of the cooking operation is performed by detecting the slope of the output value curve of a sensor. Thus, a more accurate control of the cooking operation is needed.

SUMMARY OF THE INVENTION

Accordingly, to solve the above and other problems, an object of the present invention is to provide a microwave oven control method in which the humidity of air in a cooking cavity can be accurately detected without cooling the cooking cavity.

Additional objects and advantages of the invention will be set forth in part in the description which follows and, in part, will be obvious from the description, or may be learned by practice of the invention.

In order to accomplish the above objects, embodiments of the present invention provide a microwave oven control method and apparatus, the microwave oven including a magnetron generating high-frequency waves and a sensor detecting the environmental state of air in a cooking cavity, including: a first cooking period calculating step of sampling the outputs of the sensor at preset periods and calculating a first cooking period based on the result of the sampling; a second cooking period calculating step of calculating a second cooking time based on the first cooking time and the kind of food; and a cooking step of completing a cooking operation for the second cooking time.

BRIEF DESCRIPTION OF THE DRAWINGS

The above and other objects, features and other advantages of the present invention will be more clearly understood and more readily appreciated from the following detailed description of the embodiments taken in conjunction with the accompanying drawings, in which.

DETAILED DESCRIPTION OF THE PREFERRED EMBODIMENTS

Hereinafter, microwave oven control methods and apparatuses, in accordance with the embodiments of the present invention, are described in detail with reference to the accompanying drawings.

Figure 2:
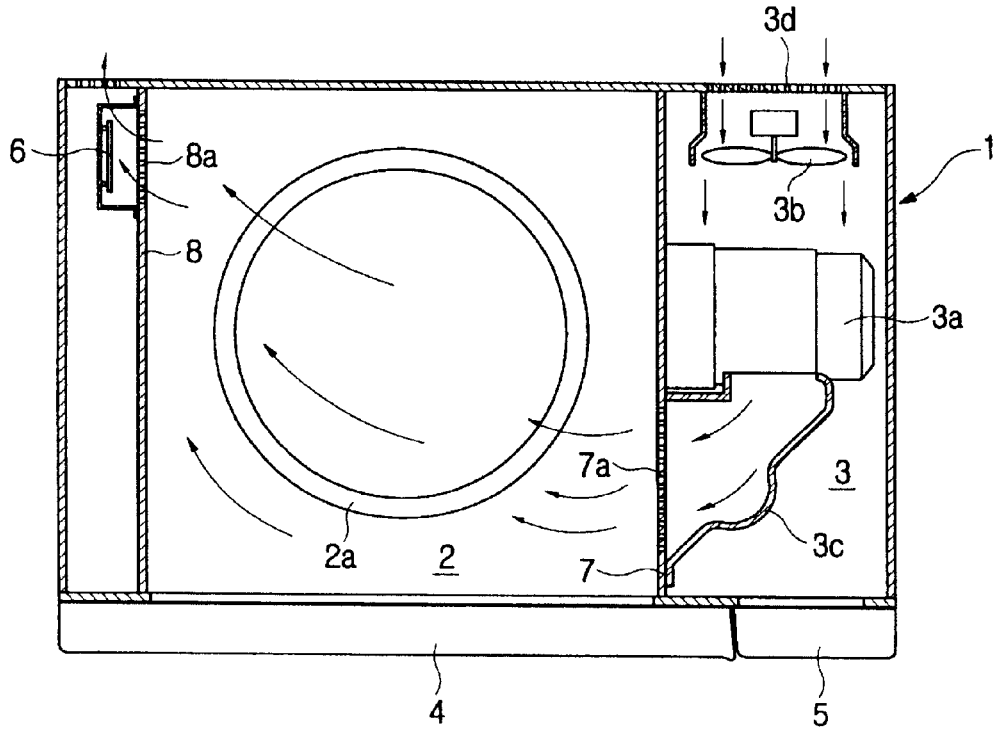
FIG. 2 is a sectional view showing a microwave oven in accordance with an embodiment of the present invention.

FIG. 2 is a sectional view showing a microwave oven in accordance with an embodiment of the present invention.

The microwave oven, as depicted in FIG. 2, includes a body 1 provided with a cooking cavity 2 and a machine room 3, a door 4 hingedly attached to the body 1 to selectively open and close the cooking cavity 2, a control panel 5 having an input unit ( to be described later) with a plurality of manipulation buttons (not shown) and a display unit ( to be described later) used to display information, and a humidity sensor 6 used to detect the humidity of air in the cooking cavity 2.

The cooking cavity 2 is constructed to be open at its front. A turntable-type cooking tray 2*a* is laid on the bottom of the cooking cavity 2. An air inlet 7*a* is formed through the front portion of one sidewall 7 of the cooking cavity to communicate with the machine room 3 and allow outside air to flow into the cooking cavity 2. An air outlet 8*a* is formed through the rear portion of the other sidewall 8 of the cooking cavity to allow air to be exhausted from the cooking cavity 2 to the outside.

A magnetron 3*a* generating high-frequency waves, a cooling fan 3*b* sucking outside air and cooling electric devices, and an air guide duct 3*c* guiding the flow of air from the machine room 3 toward the air inlet 7*a* are mounted in the machine room 3. The cooling fan 3 is disposed between the magnetron 3*a* and the rear wall of the machine room 3. A plurality of air suction holes 3*d* are formed through the rear wall of the machine room 3 to allow outside air to flow into the microwave oven.

The humidity sensor 6 is mounted on the outer surface of the second sidewall of the cooking cavity to face the air outlet 8*a* so as to be situated in a discharge passage of air. Accordingly, the humidity sensor 6 is capable of detecting the humidity of air being discharged from the cooking cavity 2 through the air outlet 8*a*. The humidity sensor 6 is electrically connected to a circuit board (not shown) enclosed in the control panel 5.

Figure 3:
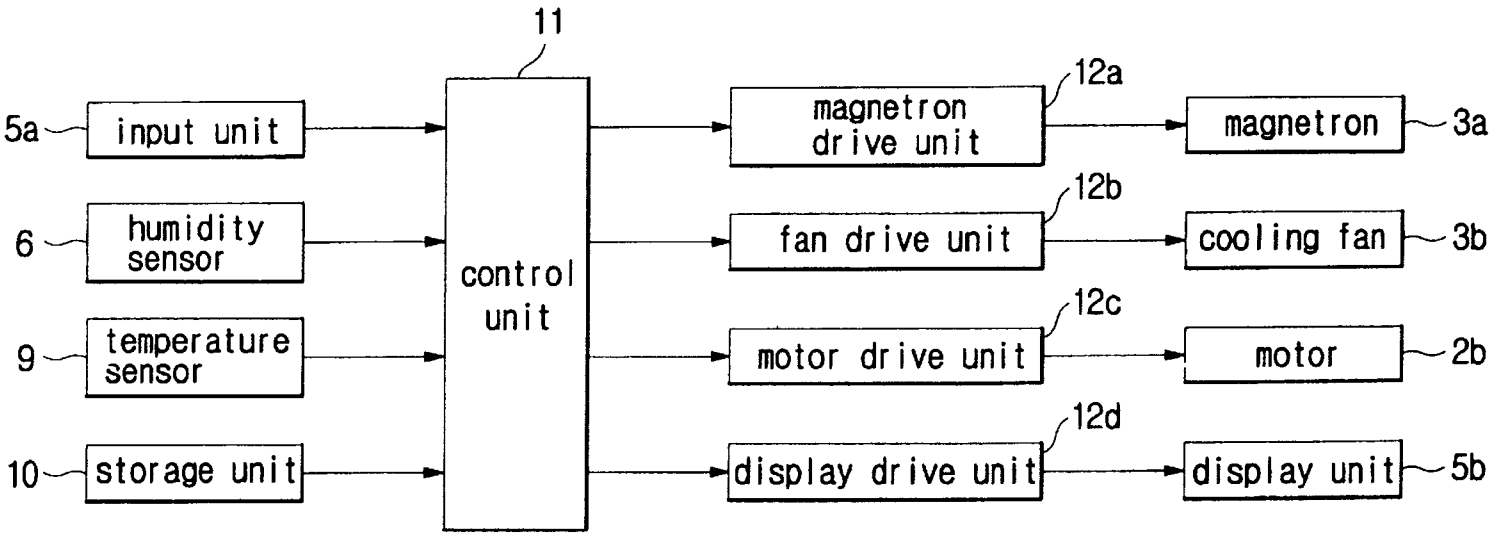
FIG. 3 is a block diagram showing the control construction of a microwave oven in accordance to another embodiment of the present invention.

FIG. 3 is a block diagram showing a control construction of a microwave oven embodiment of the present invention.

Referring to FIG. 3, the microwave oven includes a control unit 11 controlling the entire operation of the microwave oven. The input unit 5*a* mounted in the control panel 5, receiving operational commands from a user, is electrically connected to the control unit 11, and transmits to the control unit 11 signals generated by inputs from a user. The humidity sensor 6, detecting the humidity formed during a cooking operation, and a temperature sensor 9 are electrically connected to the control unit 11. A data storage unit 10 is also connected to the control unit 11.

Additionally, a magnetron drive unit 12*a* operating the magnetron 3*a*, a fan drive unit 12*b* operating the cooling fan 3*b*, a motor drive unit 12*c* operating a motor to rotate the cooking tray 2*a*, and a display drive unit 12*d* operating the display unit 5*b*, provided in the control panel 5 displaying operational states and an alarm, can all be connected to the control unit 11.

When the microwave oven of the present invention is operated by the manipulation of the input unit 5*a* provided in the control panel 5, with food being put onto the cooking tray 2*a*, the control unit 11 controls the magnetron drive unit 12*a* to operate the magnetron 3*a*. According to this control, high-frequency waves generated by the magnetron 3*a* irradiate cooking cavity 2 and cook the food.

In the meantime, during the cooking operation of the microwave oven, outside air is sucked into the machine room 3 by the operation of the cooling fan 3*b* and cools electric devices in the machine room 2. Thereafter, air is supplied to the cooling cavity 2 through the air guide duct 3*c* and the air inlet 7*a*. Subsequently, air, as indicated by the arrows of FIG. 2, is discharged from the cooking cavity 2 through the air outlet 8*a* to the outside, along with vapor released from the food being cooked. As a result, with the discharge of air, odor and vapor are removed from the cooking cavity 2. In this case, air is discharged while passing the humidity sensor 6, so the humidity sensor 6 detects humidity of the air being discharged and transmits detection signals to the control unit 11.

The control unit 11 controls the magnetron 3*a*, the motor 2*b*, and the cooling fan 3*b* to cook the food, based on the detection signals transmitted from the humidity sensor 6.

Hereinafter, a microwave oven control method of an embodiment the present invention is described.

Figure 4:
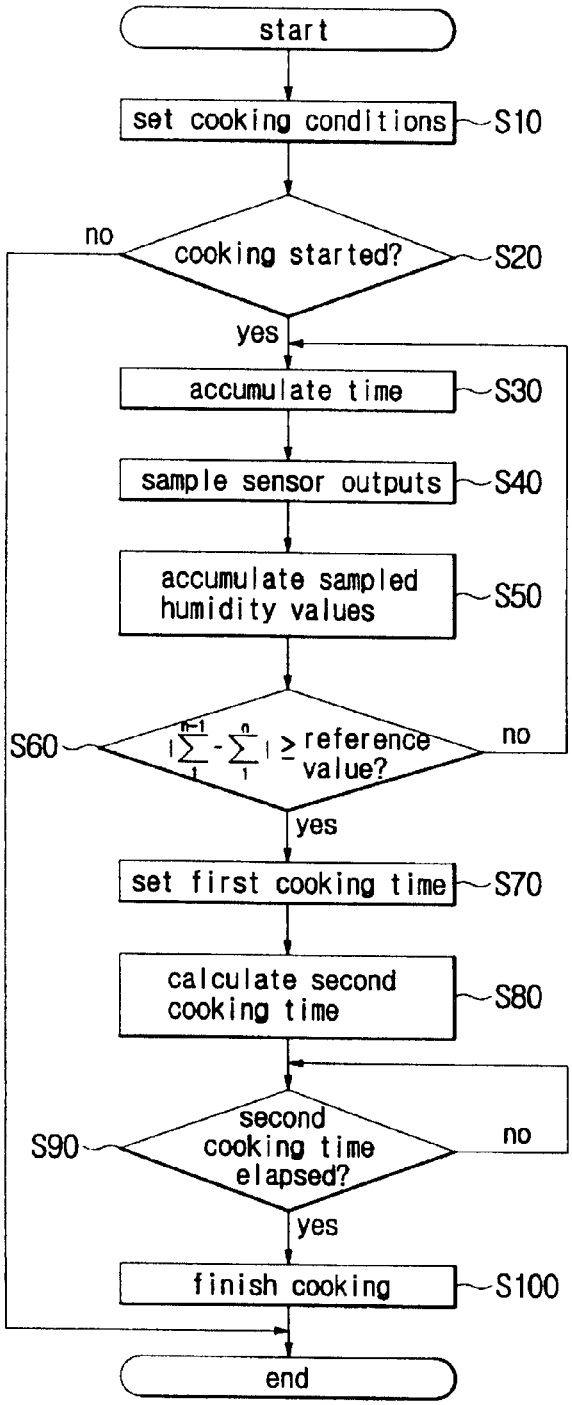
FIG. 4 is a flowchart showing a microwave oven control method in accordance with yet another embodiment of the present invention.

FIG. 4 is a flowchart showing a microwave oven control method embodiment of the present invention.

First of all, a user sets cooking conditions through the input unit 5*a*, provided in the control panel 5 (S10). The control unit 11 determines whether a cooking start command has been inputted through the input unit 5*a* (S20). If the cooking start command has been inputted, the control unit 11 controls the magnetron drive unit 12*a* to operate the magnetron 3*a* for the generation of high-frequency waves and the fan drive unit 12*b* to operate the cooling fan 3*b*. Additionally, the control unit 11 controls the motor drive unit 12*c* to operate the motor 3*b* for the rotation of the cooking tray 2*a*. Meanwhile, the control unit 11 accumulates cooking time (S30).

After the start of the cooking operation, the control unit 11 samples the output signals of the humidity sensor 6 at certain periods (S40). After sampling the output signals, the control unit 11 accumulates sampled humidity values and stores them in the data storage unit 10.

Thereafter, the control unit 11 determines whether the absolute value K of a difference between a sampled humidity value sum $$\sum_{1}^{n-1}$$

obtained at a preceding sampling stage n−1 and a sampled humidity value sum $$\sum_{1}^{n-1}$$

obtained at a current sampling stage n is greater than a reference value C, for calculating a first cooking time (S60).

In this case, $$K = \left| \text{preceding sampled humidity value sum} \sum_{1}^{n-1} - \text{current sampled humidity value sum} \sum_{1}^{n} \right| \geq \text{reference value } C.$$

If the absolute value K of a difference between a sampled humidity value sum obtained at a preceding sampling stage n−1 and a sampled humidity value sum obtained at a current sampling stage n is greater than a preset reference value C, the control unit 11 sets a current accumulated time as a first cooking time T1 (S70). Thereafter, the control unit 11 calculates a second cooking time T2 on the basis of the first cooking time T1 and a factor preset according to the kind of food (S80).

The control unit 11 determines whether the second cooking time T2 has elapsed (S90). If the second cooking time T2 has elapsed, the control unit 11 controls the magnetron drive unit 12*a* to stop the magnetron 3*a*, the fan drive unit 12*b* to stop the fan 3*b* and the motor drive unit 12 to stop the motor 2*b*, thereby finishing the cooking operation (S100).

Figure 5:
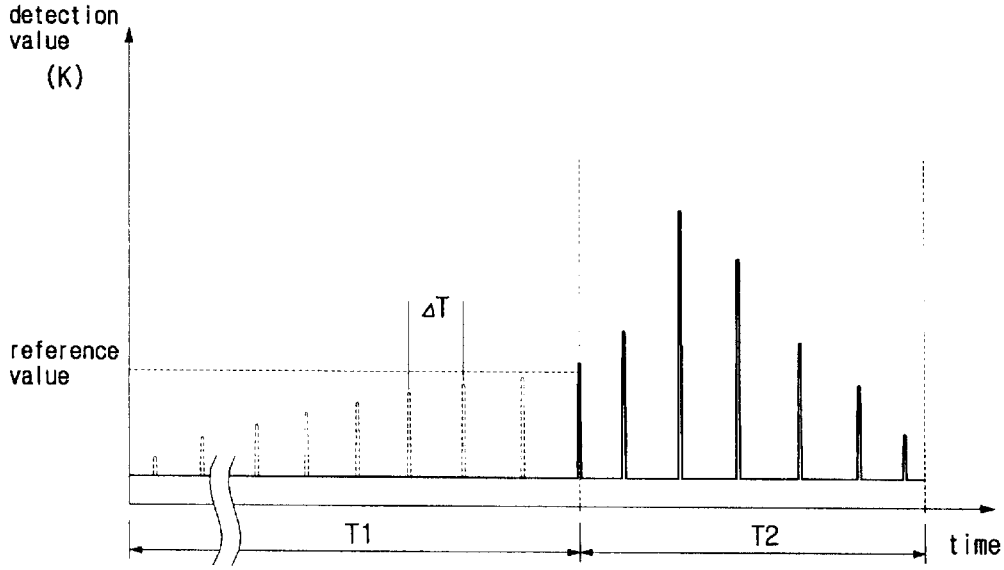
FIG. 5 is a graph explaining the microwave oven control method in accordance with a further embodiment of the present invention.

FIG. 5 is a graph explaining a microwave oven control method embodiment of the present invention.

Referring to FIG. 5, after the start of a cooking operation, the output values of the humidity sensor 6 are sampled at certain predetermined periods, e.g., periods ΔTs, and the sampled humidity values are accumulated. A first cooking time T1 is determined as the period of time from the start of the cooking operation till the absolute value of the difference between the current sampled humidity value sum $$\sum_{1}^{n-1}$$

and preceding sampled humidity value sum $$\sum_{1}^{n-1}$$

of the output values of the humidity sensor 6 is equal to the preset reference value, i.e., detecting when the output value of humidity sensor 6 changes a predetermined amount. A second cooking time T2 is calculated by multiplying the first cooking time T1 by a factor preset according to the kind of food. The cooking operation is completed after the second cooking time T2 is elapsed.

Figure 1:
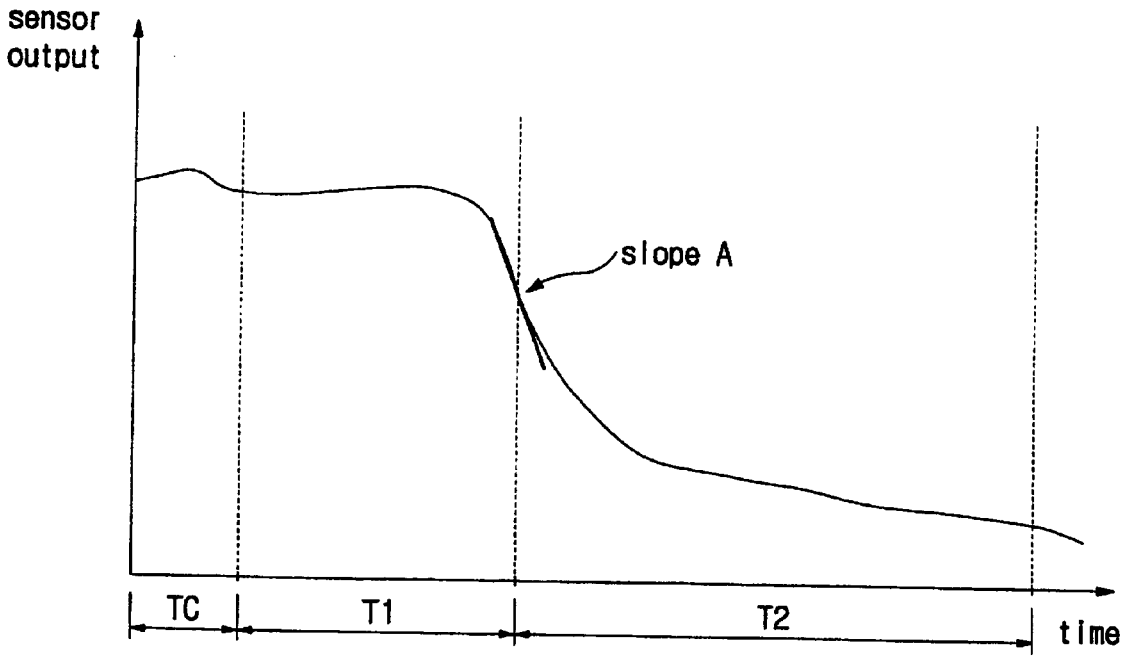
FIG. 1 (PRIOR ART)
FIG. 1 is a graph explaining a conventional microwave oven control method.

Again referring to FIG. 5, and as noted above, the point at which an abrupt change in slope occurs along a sensor output curve, such as in FIG. 1, is representative of the preferred moment of transition between the first cooking time T1 and the second cooking time T2. Thus, in an embodiment of the present invention, this abrupt change is detected by calculating the difference between two samples. When the difference between two samples equals or exceeds a preset reference value, inherently the slope between the two samples has also equaled or exceed a predetermined amount, which is representative of the abrupt change. Although the difference between two samples has been set forth in this embodiment, embodiments of the present invention could also include the detection of such abrupt changes using more than two sample points and/or alternative methodologies, e.g., such as through using polynomials or interpolation.

In brief, in a microwave oven control method and apparatus of the present invention, the output values of the humidity sensor 6 are sampled at certain periods, and a time when the absolute value of the difference between the current sampled humidity value sum and preceding sampled humidity value sum of the output values of the humidity sensor 6 is equal to the preset reference value is detected. As a result, the environmental variation of the cooking cavity, due to sequential cooking operations, does not affect the sensing of the humidity sensor 6, so the humidity of air in the cooking cavity of the microwave oven can be accurately detected.

As described above, an embodiment of the present invention provide a microwave oven control method and apparatus, in which the outputs of a humidity sensor are sampled at certain periods, the sampled humidity values are accumulated, and a time when the absolute value of the difference between the current sampled humidity value sum and preceding sampled humidity value sum of the output values of the humidity sensor is equal to the preset reference value is detected. Accordingly, the cooking control of the microwave oven can be accurately carried out by reducing an error due to sequential cooking operations, and the power consumption of the microwave oven can be reduced due to the elimination of the cooling of a cooking cavity.

Although the preferred embodiments of the present invention have been disclosed for illustrative purposes, those skilled in the art will appreciate that various modifications, additions and substitutions are possible, without departing from the scope and spirit of the invention as recited in the accompanying claims and equivalents thereof.

What is claimed is:

1. A microwave oven control method, the microwave oven including a magnetron to generate high-frequency waves and a sensor to detect an environmental state of air in a cooking cavity, comprising:

detecting outputs of the sensor during predetermined periods of a first cooking period, and detecting an abrupt change between a summation of outputs during a predetermined period and a summation of outputs from another predetermined period;

calculating the first cooking period based on the result of the detected abrupt change;

calculating a second cooking time based on the first cooking time and a kind of food in the cooking cavity; and completing a cooking operation for a duration of the second cooking time.

2. The microwave oven control method of claim 1, wherein said detecting of the outputs of the sensor and the detecting of the abrupt change further comprises:

accumulating time after the start of the cooking operation;

sampling the output values of the sensor during the predetermined period;

accumulating a sampled humidity value from summing the sampled output values;

calculating a difference between a current sampled humidity value and a preceding sampled humidity value based on the other predetermined period;

determining whether an absolute value of the calculated difference is greater than a preset reference value; and setting the current sampled humidity value as the first cooking time if the absolute value of the difference is greater than the preset reference value.

3. The microwave oven control method of claim 1, wherein said second cooking time is calculated by multiplying said first cooking time by a factor preset according to the kind of food in the cooking cavity.

4. A microwave oven control method, comprising:

operating a microwave oven magnetron for a first cooking period; and calculating the first cooking period based on when a correlation between summations of at least two different multiple samplings of detected sensor outputs, of a sensor, indicate that an output value curve for the sensor has reached or exceeded a predetermined slope.

5. The microwave oven control method of claim 4, further comprising operating the microwave oven magnetron for a second cooking period based on the calculated first cooking period and a preset factor.

6. The microwave oven control method of claim 4, wherein the correlation between the summations includes calculating a difference between two summations of corresponding multiple samplings and determining whether an absolute value of the calculated difference equals or exceeds a predetermined value.

7. The microwave oven control method of claim 4, wherein the correlation between the summations includes approximating a polynomial curve based on the summations and wherein the slope of the output value curve is determined based on the approximated polynomial curve.

8. The microwave oven control method of claim 4, wherein the correlation between the summations includes performing an interpolation between the summations and wherein the slope of the output value curve is determined based on the performed interpolation.

9. The microwave oven control method of claim 4, wherein the sensor is a humidity sensor.

10. A computer readable medium encoded with processing instructions for implementing a method of microwave oven control performed by a computing device, the method comprising:

operating a microwave oven magnetron for a first cooking period; and calculating the first cooking period based on when a correlation between summations of at least two different multiple samplings of detected sensor outputs, of a sensor, indicate that an output value curve for the sensor has reached or exceeded a predetermined slope.

11. The computer readable medium of claim 10, further comprising processing instructions for operating the microwave oven magnetron for a second cooking period based on the calculated first cooking period and a preset factor.

12. The computer readable medium of claim 10, wherein the correlation between the summations includes calculating a difference between two summations of corresponding multiple samplings and determining whether an absolute value of the calculated difference equals or exceeds a predetermined value.

13. The computer readable medium of claim 10, wherein the correlation between the summations includes approximating a polynomial curve based on the summations and wherein the slope of the output value curve is determined based on the approximated polynomial curve.

14. The computer readable medium of claim 10, wherein the correlation between the summations includes performing an interpolation between the summations and wherein the slope of the output value curve is determined based on the performed interpolation.

15. The microwave oven control method of claim 10, wherein the sensor is a humidity sensor.

16. A microwave oven, comprising:

a magnetron to generate high-frequency waves;

a sensor to detect and output multiple outputs representative of environmental states of air in a cooking cavity; and a control unit to operate said magnetron for a first period, to calculate the first period based on when a correlation between summations of at least two different multiple samplings of sensor outputs indicates that an output value curve for said sensor has reached or exceeded a predetermined slope, and to operate said magnetron for a second period based on the calculated first period and a preset factor.

17. The microwave oven of claim 16, wherein the control unit calculates the correlation between the summations by calculating a difference between two summations of corresponding multiple samplings and determining whether an absolute value of the calculated difference equals or exceeds a predetermined value.

18. The microwave oven of claim 16, wherein the control unit calculates the correlation between the summations by approximating a polynomial curve based on the summations and determining the slope of the output value curve based on the approximated polynomial curve.

19. The microwave oven of claim 16, wherein the control unit calculates the correlation between the summations by performing an interpolation between the summations and determining the slope of the output value curve based on the performed interpolation.

20. The microwave oven of claim 16, wherein the sensor is a humidity sensor.

21. A microwave oven control method, the microwave oven including a magnetron to generate high-frequency waves and a sensor to detect an environmental state of air in a cooking cavity, comprising:

determining a first cooking time by detecting when summations of different multiple samplings of an output level of the sensor change a predetermined amount during a predetermined period;

calculating a second cooking time based on the first cooking time and a kind of food in the cooking cavity; and completing a cooking operation for a duration of the second cooking time.

22. The microwave oven control method of claim 21, wherein the detecting of when the summations change a predetermined amount is achieved by calculating a difference between two summations of corresponding multiple samplings and determining whether an absolute value of the calculated difference equals or exceeds a predetermined value.

* * * * *